US008002580B2

(12) United States Patent
Huixiong et al.

(10) Patent No.: US 8,002,580 B2
(45) Date of Patent: Aug. 23, 2011

(54) COAXIAL CABLE CRIMP CONNECTOR

(75) Inventors: Luo Huixiong, Suzhou (CN); Li Zuhui, Suzhou (CN); Zheng Jien, Suzhou (CN); Graham Hale, Manhattan, IL (US)

(73) Assignee: Andrew LLC, Hickory, NC (US)

( * ) Notice: Subject to any disclaimer, the term of this patent is extended or adjusted under 35 U.S.C. 154(b) by 64 days.

(21) Appl. No.: 12/130,369

(22) Filed: May 30, 2008

(65) Prior Publication Data

US 2009/0233483 A1 Sep. 17, 2009

(30) Foreign Application Priority Data

Mar. 17, 2008 (CN) ..... 2008 1 0096321

(51) Int. Cl.
*R01R 9/05* (2006.01)

(52) U.S. Cl. ..... 439/585

(58) Field of Classification Search ..... 439/585, 439/578, 583, 584
See application file for complete search history.

(56) References Cited

U.S. PATENT DOCUMENTS 2,941,028 A 6/1960 Edlen et al.
3,034,090 A * 5/1962 Noschese ..... 439/593
4,553,806 A * 11/1985 Forney, Jr. et al. ..... 439/277
4,684,201 A 8/1987 Hutter
4,990,106 A 2/1991 Szegda
5,073,129 A 12/1991 Szegda
5,217,393 A 6/1993 Del Negro et al.
5,393,244 A 2/1995 Szegda
5,499,934 A 3/1996 Jacobsen et al.
5,542,861 A * 8/1996 Anhalt et al. ..... 439/578
5,877,452 A 3/1999 McConnell
5,879,191 A 3/1999 Burris
5,975,949 A 11/1999 Holliday et al.
6,840,803 B2 * 1/2005 Wlos et al. ..... 439/585
6,848,941 B2 2/2005 Wlos et al.
7,044,785 B2 5/2006 Harwath et al.
7,217,155 B2 * 5/2007 Montena ..... 439/578

* cited by examiner

*Primary Examiner* — Tulsidas Patel
*Assistant Examiner* — Phuong Nguyen
(74) *Attorney, Agent, or Firm* — Babcock IP, PLLC

(57) ABSTRACT

A connector for semi-rigid outer conductor coaxial cable having a body provided with a connection interface at a connector end, a body bore and a crimp area around an outer surface of the body. The body bore dimensioned to receive the outer conductor together with a cylindrical sleeve dimensioned to receive the outer conductor therethrough when the outer conductor is folded back over the sleeve, to a position along the body bore corresponding to the crimp area.

17 Claims, 5 Drawing Sheets

COAXIAL CABLE CRIMP CONNECTOR

CROSS REFERENCE TO RELATED APPLICATIONS

This application claims the benefit of China Patent Application No.: 200810096321.0, titled "Coaxial Cable Crimp Connector", filed Mar. 17, 2008 by Luo Huixiong, Li Zuhui, Zheng Jien and Graham Hale and hereby incorporated by reference in its entirety.

BACKGROUND OF THE INVENTION

1. Field of the Invention

The invention relates to electrical connectors for coaxial cable. More specifically, the invention relates to cost efficient low loss connectors suitable for field installation upon flexible and or semi-rigid outer conductor coaxial cable using common hand tools.

2. Description of Related Art

Prior low cost crimp connectors, secured to the coaxial cable end(s) via application of a radial inward crimping force upon the connector body, have previously relied upon an integral inner sleeve coupled to the body to prevent collapse of the coaxial cable under the crimping force. The coaxial cable is inserted into the cable end of the body, against the sleeve that is driven between the outer conductor and the cable dielectric. Depending upon the coaxial cable used, it may be difficult to separate the outer conductor from the cable dielectric, to allow insertion of the inner sleeve there between, which frustrates connector installation. The body is then crimped against the inner sleeve supported outer conductor, creating a secure mechanical and electrical connection between the outer conductor and the connector body.

The narrow annular groove open to the cable end of the connector body, between the body and the inner sleeve, is dimensioned to receive the outer conductor of the cable end easily, yet not be so large that the distance the body must be deformed during crimping results in fracturing of the body. This dimensional conflict makes it difficult to apply reliable and or cost effective environmental seals between the cable and the connector body, to prevent moisture infiltration into the interconnection space that can degrade the electrical characteristics of the connection.

Competition within the cable and connector industry has increased the importance of improving the electrical characteristics of the interconnection while minimizing installation time, required installation tools, and or connector manufacturing and or materials costs.

Therefore, it is an object of the invention to provide a coaxial connector that overcomes deficiencies in the prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Connector end 10 and cable end 20 are each applied herein as side identifications for individual elements of the crimp connector 1 along a longitudinal axis of the connector 1, to provide position references for element features described and inter-element contacting surface clarification.

Figure 1:
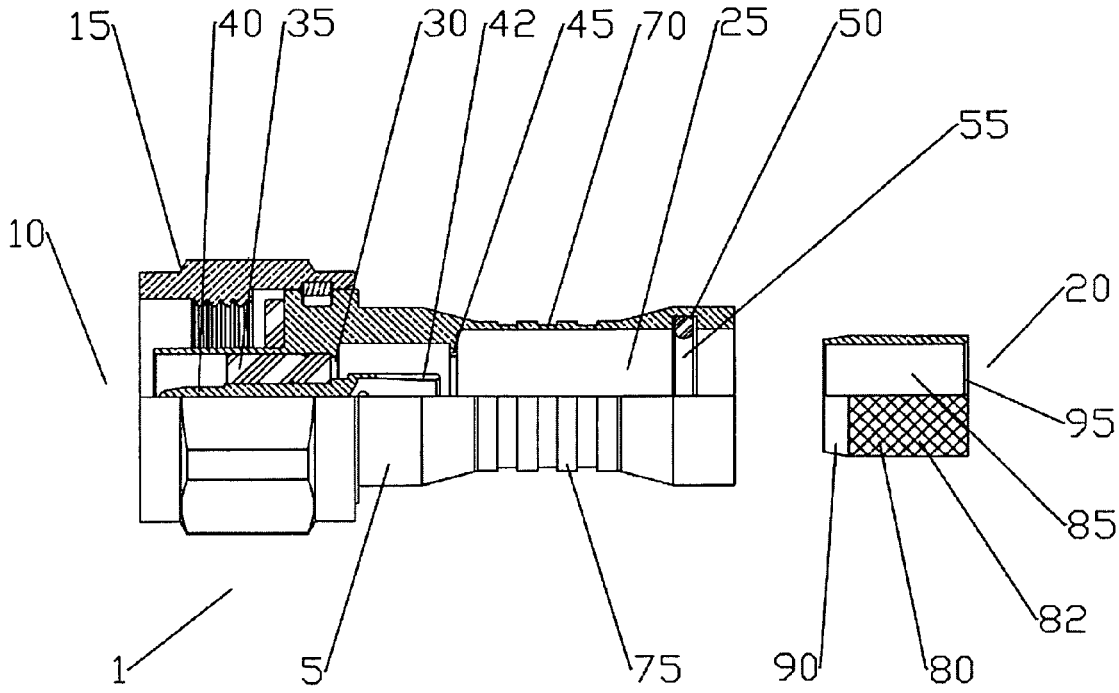
FIG. 1 shows a schematic external side and partial section view of one embodiment of the invention.

An exemplary embodiment of a crimp connector 1 is demonstrated in FIG. 1. A crimp connector body 5 has a connection interface 15, at cable end 10. The specific form of connection interface 15 applied to the connector end 10 may be selected according to the intended coaxial cable diameter/type and or the application the crimp connector is intended for, for example, standard Type N, BNC, SMA, DIN, UHF, EIA, CATV (Type F), or a proprietary connector or cable interconnection configuration. Dimensions and or configuration of standard connector interfaces are well known in the art. Therefore, details of the connector end 10 and any required additional elements such as coupling nuts, threads, seals or the like are not further described herein. A connector end 10 provided with a type N connector interface configuration is demonstrated in the exemplary embodiment.

Figure 2:
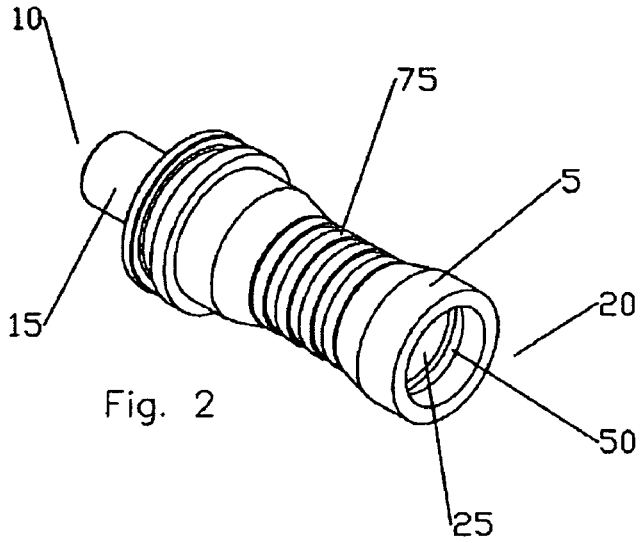
FIG. 2 shows a schematic external angled isometric view of the body of the embodiment of the invention shown in FIG. 1.
Figure 3:
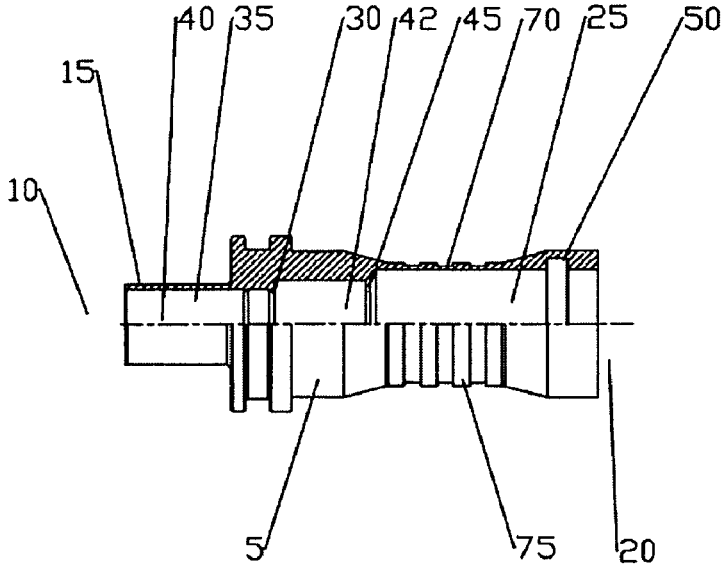
FIG. 3 shows a schematic side and partial section view of the body of the embodiment of the invention shown in FIG. 2.
Figure 4:
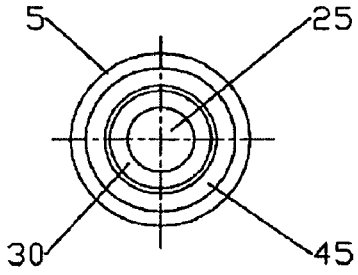
FIG. 4 shows an external cable end view of the body of the embodiment of the invention shown in FIG. 1.

As best shown in FIGS. 2-4, the body 5 has a through body bore 25 coaxial with a longitudinal axis. An insulator shoulder 30 projecting into the body bore 25 may be formed as a stop for an insulator 35 supporting an inner contact 40 coaxial with the body bore 25. The inner contact 40 is preferably provided at the cable end 20 with a plurality of spring finger (s) 42 or the like biased inward to securely grip an inner conductor 44 of the coaxial cable 65 upon insertion (see FIG. 8). Alternatively, the inner contact 40 may be configured for interconnection with the inner conductor 44 via soldering and or conductive adhesive. A cable shoulder 45, formed as a step or other inward projection, projecting into the body bore 25 is operative as a stop for the coaxial cable 65 during insertion into the body bore 25 from the cable end 20 of the body 5. An inward facing annular seal groove 50 formed in the body bore 25 proximate the cable end 20 may be provided as a seating surface for an environmental seal 55, such as an elastomeric o-ring or other form of gasket. The body 5 may be formed from, for example brass or other metal alloy. To minimize corrosion and or dissimilar metal reactions with the connector end 10 and or the outer conductor 60 of the coaxial cable 65, the body 5 may be provided with a corrosion resistant plating, for example, tin or chromium plating.

An outer surface of the body 5, generally between and spaced away from the cable shoulder 45 and the seal groove 50, if present, or cable end 20 is provided with a crimp area 70 dimensioned for a desired crimp tool. The outer diameter of the crimp area 70 may be adjusted to mate with, for example, industry standard hexagonal crimp hand tools by adjusting the diameter of the body 5 in the crimp area 70. A plurality of ridge(s) 75 may be formed in the crimp area 70. The depth and width of grooves between the ridge(s) 75 may be selected to adjust the compressive force, for example to be within the range of force generatable by a hand tool, required to crimp/deform the crimp area 70 of the body 5 against the sleeve 80, described below, during a crimp operation and also to create a corresponding retentive strength of the compressed material once crimped.

Figure 5:
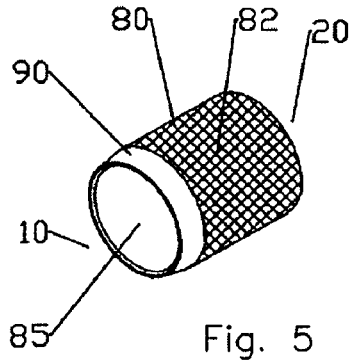
FIG. 5 shows a schematic external angled isometric view of the sleeve of the embodiment of the invention shown in FIG. 1.

As best shown in FIG. 5, a separate cylindrical sleeve 80 is dimensioned with a sleeve bore 85 diameter dimensioned to slide over the outer conductor 60 (see FIG. 6) of the desired coaxial cable 65 and an outer diameter dimension in combination with the body bore 25 diameter to allow insertion of the sleeve 80 into the body bore 25 space corresponding to the crimp area 70 when the sleeve 80, inserted over the end of the coaxial cable 65 outer conductor 60, has the outer conductor 60 also folded and or wrapped backwards over the sleeve 80, generally enclosing the sleeve 80 and increasing the effective diameter of the sleeve 80 and outer conductor 60 combination by double the thickness of the outer conductor 60.

The sleeve 80 may be formed with a ridged, knurled or otherwise textured or roughened gripping outer surface 82 to improve a cable/connector separation force after interconnection. The sleeve 80 may also be formed with a beveled or chamfered leading edge 90, at a connector end 10, such that when the outer conductor 60 is wrapped around the sleeve 80, the leading edge 90 of the sleeve 80 and outer conductor 60 combination is angled to provide ease of initial insertion of the coaxial cable 65 end into the body bore 25. Similarly, the cable end 20 of the sleeve 80 may be formed with an inverted beveled or chamfered end surface 95 at the cable end 20 for ease of initial insertion of the outer conductor 60 through the sleeve bore 85.

The sleeve 80 may be formed from, for example brass, aluminum or other metal alloy. Although a material identical to that applied to the body 5 may be used, material for the sleeve 80 may be selected to have a greater rigidity characteristic than the body 5 material, whereby as the crimp area 70 of the body 5 deforms under the force of the crimping action applied, the sleeve 80 is not likely to also deform under the same force level and or allowing the sleeve 80 to have reduced sidewall thickness. The sleeve 80 provides a support surface around which the deformation occurs, sandwiching the outer conductor 60 between the body 5 and the outer surface 82 resulting in a secure electro-mechanical interconnection between the outer conductor 60 and the body 5. To minimize corrosion and or dissimilar metal reactions with the outer conductor 60 of the coaxial cable 65, the sleeve 80 may also be provided with a corrosion resistant plating, for example, tin or chromium plating.

Figure 6:
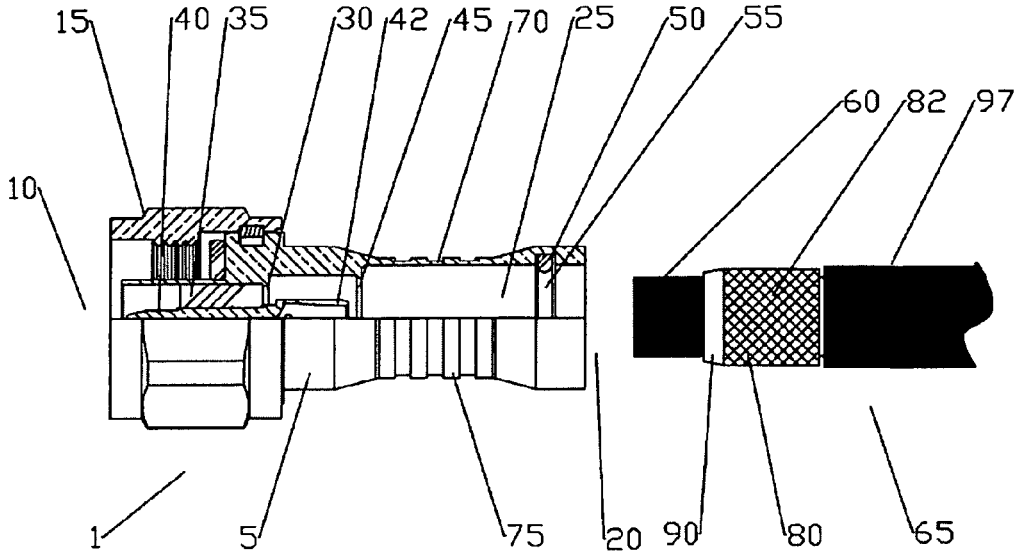
FIG. 6 shows a schematic external side and partial section view of one embodiment of the invention, with the sleeve mounted on a cable.
Figure 7:
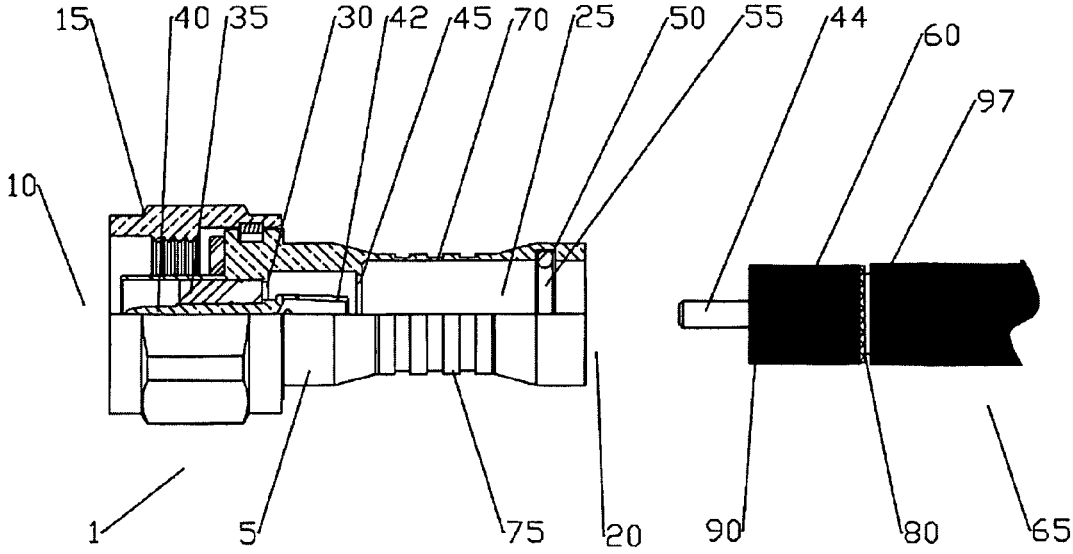
FIG. 7 shows a schematic external side and partial section view of one embodiment of the invention, with the sleeve mounted on a cable, the outer conductor folded over the sleeve.
Figure 8:
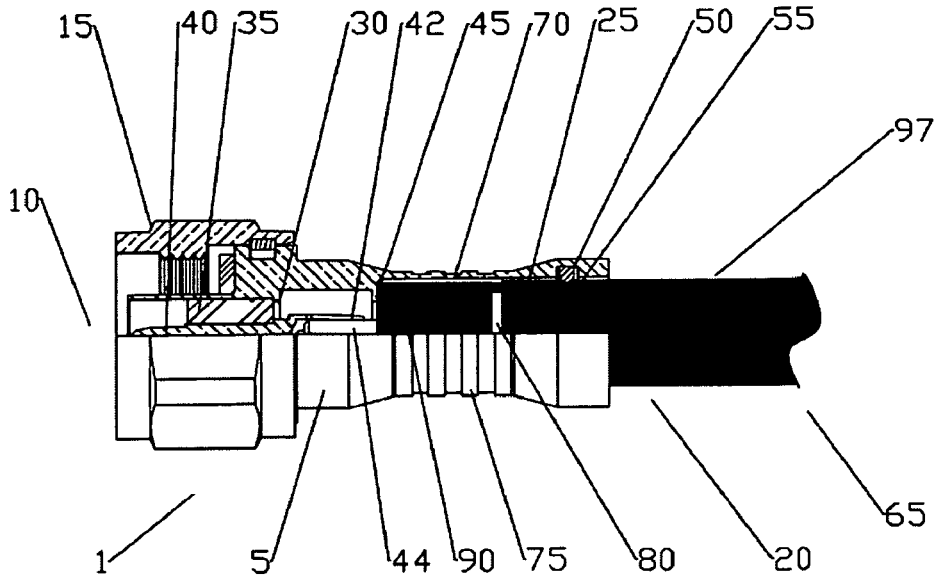
FIG. 8 shows a schematic external side and partial section view of one embodiment of the invention, with the cable and sleeve inserted within the body bore.
Figure 9:
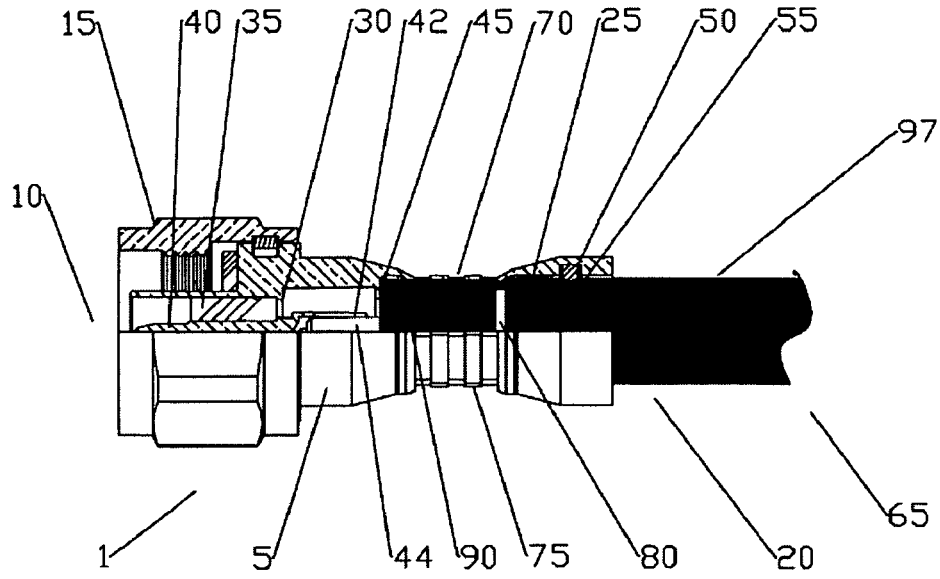
FIG. 9 shows a schematic external side and partial section view of one embodiment of the invention, with the cable and sleeve inserted within the body bore, after application of the crimping force.

A coaxial cable 65 with any form of flexible and or semi-rigid outer conductor 60, such as a braided and or foil outer conductor 60 may be prepared for interconnection with the crimp connector 1 by removing a portion of outer sheath 97 from the end of the outer conductor 60. The sleeve 80 is then slid over the exposed outer conductor 60, as shown in FIG. 6, and the outer conductor 60 folded over the sleeve 80 outer surface 82. The dielectric 99 exposed by the folding of the outer conductor 60 over the sleeve 80 is then removed to expose a corresponding length of the inner conductor 44, as shown in FIG. 7 (unless the selected connector interface 15 applies the dielectric 99 as the inner conductor 44 spacing/supporting element, as demonstrated in FIG. 11). The end of the inner conductor 44 may be ground to remove sharp edges that may be present. The coaxial cable 65 is then inserted into the cable end 20 of the body bore 25 until the outer conductor 60 abuts the cable shoulder 45. As the coaxial cable 65 is inserted into the body bore 25, the inner conductor 44 engages the spring finger(s) 42 of the inner contact 40 and the outer sheath 97 is inserted past the annular seal groove 50 and the environmental seal 55 seated therein, sealing the cable end 20 of the coaxial cable 65 and crimp connector 1 interconnection, as shown in FIG. 8. Alternatively, the inner contact 40 may be soldered or conductively glued to the inner conductor 44, prior to and or upon insertion.

The coaxial cable and crimp connector 1 interconnection is finalized by applying a radial crimping force, for example via a standard hexagonal hand crimping tool, to the crimp area 70, deforming the crimp area 70 inward, driving the crimp area 70 against the sleeve 80, the folded over portion of the outer conductor 60 clamped between the sleeve 80 outer surface 82 and the crimp area 70 of the body 5 to form a secure, permanent electro-mechanical interconnection.

For pre-connection cable end preparation, specific distances for stripping back elements of the coaxial cable 65 are determined by the applicable coaxial cable 65 and crimp connector 1 dimensions, such that when the outer conductor 60 abuts the cable shoulder 45, the inner conductor 44 mates securely with the inner contact 40 and, if present, the environmental seal 55 contacts the outer sheath 97.

Figure 10:
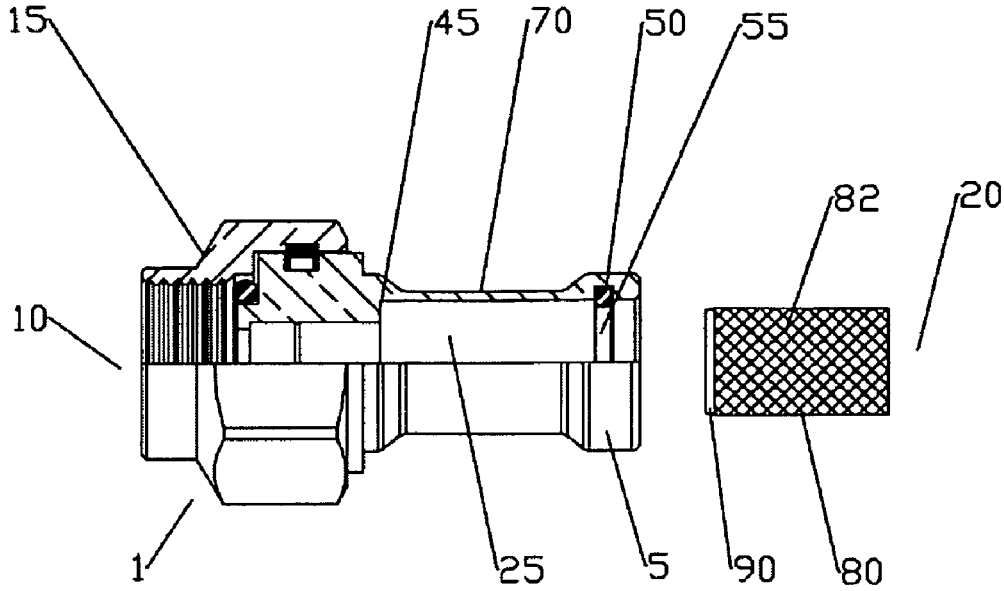
FIG. 10 shows a schematic external side and partial section view of an alternative embodiment of the invention having a Type F connection interface.
Figure 11:
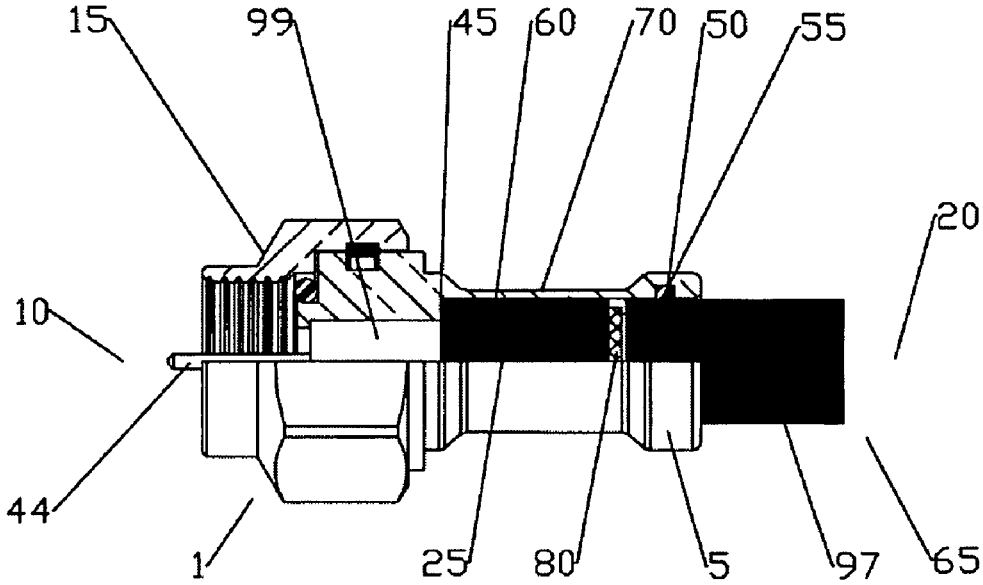
FIG. 11 shows a schematic external side and partial section view of an alternative embodiment of the invention having a Type F connection interface, with the cable and sleeve inserted within the body bore.

One skilled in the art will appreciate that where the selected connection interface 15 does not require an inner contact 40 and or insulator 35, these elements are omitted, for example as shown in FIGS. 10 and 11, where the connector interface is a Type F. Further, where the dimensions of the associated coaxial cable and or desired level of retentive strength met by the crimp area 70 body 5 sidewall thickness, ridge(s) 75 are similarly not an essential element of the crimp connector 1.

As described, the crimp connector 1 provides the following advantages. The crimp connector has a limited number of components having simplified manufacturing requirements and may be cost effectively assembled with only a few manufacturing operations. The crimp connector 1 may be quickly installed in the field, without requiring soldering or conductive adhesives, using only industry standard hand tools. Also, the elimination of the integral inner sleeve enables configuration of the crimp connector with a significantly improved environmental seal, with minimal additional manufacturing and or materials cost.

Table of Parts

| | |
|---|---|
| 1 | crimp connector |
| 5 | body |
| 10 | connector end |
| 15 | connection interface |
| 20 | cable end |
| 25 | body bore |
| 30 | insulator shoulder |
| 35 | insulator |
| 40 | inner contact |

-continued

| Table of Parts | |
|---|---|
| 42 | spring finger |
| 44 | inner conductor |
| 45 | cable shoulder |
| 50 | seal groove |
| 55 | environmental seal |
| 60 | outer conductor |
| 65 | coaxial cable |
| 70 | crimp area |
| 75 | ridge |
| 80 | sleeve |
| 82 | outer surface |
| 85 | sleeve bore |
| 90 | leading edge |
| 95 | end surface |
| 97 | outer sheath |
| 99 | dielectric |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A connector for semi-rigid outer conductor coaxial cable, comprising:

a body provided with a connection interface at a connector end, a body bore and a crimp area around an outer surface of the body; and a cylindrical sleeve with a sleeve bore dimensioned to receive the outer conductor therethrough;

the body bore dimensioned to receive the outer conductor together with the sleeve mounted upon the outer conductor and the outer conductor folded back over the sleeve, to a position along the body bore corresponding to the crimp area; and a cable shoulder of the body projecting inward into the body bore; the cable shoulder positioned along a longitudinal axis of the body, whereby the sleeve is positioned under the crimp area when the outer conductor abuts the cable shoulder.

2. The connector of claim 1, further including an environmental seal seated in a seal groove of the body bore, proximate a cable end of the crimp area.

3. The connector of claim 1, further including a plurality of annular ridges in the crimp area.

4. The connector of claim 1, further including an inner contact supported coaxial within the body bore by an insulator.

5. The connector of claim 1, wherein the sleeve has a textured outer surface.

6. The connector of claim 1, wherein the sleeve has a beveled edge at a connector end.

7. The connector of claim 1, wherein the sleeve is provided with a greater rigidity characteristic than the crimp area of the body.

8. The connector of claim 1, further including an environmental seal seated in a seal groove of the body bore, proximate a cable end of the body.

9. The connector of claim 8, wherein the environmental seal is an elastomer o-ring.

10. A method for interconnecting a coaxial cable with a connector, comprising the steps of:

removing a section of an outer sheath of the coaxial cable;

placing a cylindrical sleeve over an outer conductor of the coaxial cable;

folding the outer conductor over the sleeve;

inserting the coaxial cable into a body bore of a body, until the outer conductor abuts a cable shoulder of the body projecting inward into the body bore, which positions the sleeve is under a crimp area of the body; and applying a crimp force to deform the crimp area to clamp the outer conductor between the sleeve and the body.

11. The method of claim 10, further including the step of removing a section of a dielectric exposed by the folding of the outer conductor over the sleeve; and upon insertion of the coaxial cable into the body bore, an inner conductor of the coaxial cable is inserted into an inner contact of the connector.

12. The method of claim 10, wherein an environmental seal seated within a seal groove of the body bore seals against the outer sheath when the sleeve is under the crimp area.

13. A connector for semi-rigid outer conductor coaxial cable, comprising:

a body provided with a connection interface at a connector end, a body bore and a crimp area around an outer surface of the body; the body bore provided with a cable shoulder projecting inward into the body bore;

an environmental seal seated in a seal groove of the body bore, proximate a cable end of the body; and a cylindrical sleeve with a sleeve bore dimensioned to receive the outer conductor therethrough;

the body bore dimensioned to receive the outer conductor together with the sleeve mounted upon the outer conductor and a portion of the outer conductor folded back over the sleeve, to a position along the body bore corresponding to the crimp area; and the cable shoulder positioned along a longitudinal axis of the body, whereby the sleeve is positioned under the crimp area when the outer conductor abuts the cable shoulder.

14. The connector of claim 13, further including a textured outer surface on the sleeve.

15. The connector of claim 13, wherein the sleeve has a beveled edge at a connector end.

16. The connector of claim 13, wherein the crimp area is located between the cable shoulder and the seal groove.

17. The connector of claim 13, wherein the sleeve is provided with a greater rigidity characteristic than the crimp area of the body.

* * * * *